US006431291B1

(12) United States Patent
Moore et al.

(10) Patent No.: US 6,431,291 B1
(45) Date of Patent: Aug. 13, 2002

(54) PACKERFOOT WITH BLADDER ASSEMBLY HAVING REDUCED LIKELIHOOD OF BLADDER DELAMINATION

(75) Inventors: Norman Bruce Moore, Aliso Viejo; Phillip Mock, Newport Beach, both of CA (US)

(73) Assignee: Western Well Tool, Inc., Anaheim, CA (US)

( * ) Notice: Subject to any disclaimer, the term of this patent is extended or adjusted under 35 U.S.C. 154(b) by 0 days.

(21) Appl. No.: 09/881,480

(22) Filed: Jun. 14, 2001

(51) Int. Cl.[7] ..... E21B 33/127
(52) U.S. Cl. ..... 175/73; 175/230; 166/187
(58) Field of Search ..... 175/73, 74, 76, 175/230, 234; 166/387, 187, 191

(56) References Cited

U.S. PATENT DOCUMENTS

| | | | |
|---|---|---|---|
| 2,167,194 | A | 7/1939 | Anderson |
| 2,271,005 | A | 1/1942 | Grebe |
| 2,946,565 | A | 7/1960 | Williams |
| 2,946,578 | A | 7/1960 | De Smaele |
| 3,138,214 | A | 6/1964 | Bridwell |
| 3,180,437 | A | 4/1965 | Kellner et al. |
| 3,185,225 | A | 5/1965 | Ginies |
| 3,224,734 | A | 12/1965 | Hill |
| 3,225,843 | A | 12/1965 | Ortloff et al. |
| 3,376,942 | A | 4/1968 | Van Winkle |
| 3,497,019 | A | 2/1970 | Ortloff |
| 3,599,712 | A | 8/1971 | Magill |
| 3,606,924 | A | 9/1971 | Malone |
| 3,797,589 | A | 3/1974 | Kellner et al. |
| RE28,449 | E | 6/1975 | Edmond |
| 3,941,190 | A | 3/1976 | Conover |
| 3,978,930 | A | 9/1976 | Schroeder |
| 4,085,808 | A | 4/1978 | Kling |
| 4,095,655 | A | 6/1978 | Still |
| 4,141,414 | A | 2/1979 | Johansson |
| 4,314,615 | A | 2/1982 | Sodder, Jr. et al. |
| 4,365,676 | A | 12/1982 | Boyadjieff et al. |
| 4,372,161 | A | 2/1983 | de Buda et al. |

FOREIGN PATENT DOCUMENTS

| | | |
|---|---|---|
| EP | 0 257 744 B1 | 1/1995 |
| GB | 2 355 476 A | 10/1999 |
| GB | 2 346 908 A | 8/2000 |
| WO | WO 00/36266 | 6/2000 |

*Primary Examiner*—Frank Tsay
(74) *Attorney, Agent, or Firm*—Knobbe, Martens, Olson & Bear, LLP

(57) ABSTRACT

A packerfoot includes a bladder assembly comprising an elongated generally tubular inflatable bladder having ends bonded to generally rigid bladder attachment portions. The bladder includes end portions bonded to the bladder attachment portions and a central inflatable portion. The bladder comprises multiple layers of rubber, one or more of which are reinforced by fibers, preferably S-glass. At each end of the bladder, the layers terminate at different longitudinal positions, forming annular steps on the exterior surface of the bladder. Conforming annular steps are formed on the interior surface of the bladder attachment portions. The bladder ends are bonded to the bladder attachment portions such that the annular steps of the bladder conform to the annular steps of the bladder attachment portions. The total bond length of the bladder to the bladder attachment portions is greater than or equal to twice the length of the inflatable portion of the bladder. The ratio of the bond length at each end of the bladder to the thickness of the fiber-reinforced portion of the bladder is greater than 25, and preferably greater than 50. A plurality of toes is retained on the exterior of the bladder by retaining rings that enclose the ends of the toes. Compressible strain-relief rings are positioned between the retaining rings and the ends of the toes to reduce stress concentrations in the bladder caused by the toe ends during inflation of the bladder.

37 Claims, 7 Drawing Sheets

U.S. PATENT DOCUMENTS

| | | | |
|---|---|---|---|
| 4,463,814 | A | 8/1984 | Horstmeyer et al. |
| 4,558,751 | A | 12/1985 | Huffaker |
| 4,615,401 | A | 10/1986 | Garrett |
| 4,674,914 | A | 6/1987 | Wayman et al. |
| 4,686,653 | A | 8/1987 | Staron et al. |
| 4,811,785 | A | 3/1989 | Weber |
| 4,821,817 | A | 4/1989 | Cendre et al. |
| 4,951,760 | A | 8/1990 | Cendre et al. |
| 5,010,965 | A | 4/1991 | Schmelzer |
| 5,184,676 | A | 2/1993 | Graham et al. |
| 5,186,264 | A | 2/1993 | du Chaffaut |
| 5,310,012 | A | 5/1994 | Cendre et al. |
| 5,363,929 | A | 11/1994 | Williams et al. |
| 5,425,429 | A | 6/1995 | Thompson |
| 5,467,832 | A | 11/1995 | Orban et al. |
| 5,613,568 | A | 3/1997 | Sterner et al. |
| 5,752,572 | A | 5/1998 | Baiden et al. |
| 5,758,731 | A | 6/1998 | Zollinger |
| 5,758,732 | A | 6/1998 | Liw |
| 5,794,703 | A | 8/1998 | Newman et al. |
| 5,803,193 | A | 9/1998 | Krueger et al. |
| 6,003,606 | A | 12/1999 | Moore et al. |
| 6,026,911 | A | 2/2000 | Angle et al. |
| 6,031,371 | A | 2/2000 | Smart |

PACKERFOOT WITH BLADDER ASSEMBLY HAVING REDUCED LIKELIHOOD OF BLADDER DELAMINATION

BACKGROUND OF THE INVENTION

1. Field of the Invention

This invention relates generally to packerfeet for use with downhole drilling tools, and specifically to a packerfoot having a bladder assembly configured for longer life and reduced risk of delamination of the bladder.

2. Description of the Related Art

Tools for moving within underground boreholes are used for a variety of purposes, such as oil drilling, mining, laying communication lines, and many other purposes. In the petroleum industry, for example, a typical oil well comprises a vertical borehole that is drilled by a rotary drill bit attached to the end of a drill string. The drill string may be constructed of a series of connected links of drill pipe that extend between ground surface equipment and the aft end of the downhole tool. Alternatively, the drill string may comprise flexible tubing or "coiled tubing" connected to the aft end of the tool. A drilling fluid, such as drilling mud, is pumped from the ground surface equipment through an interior flow channel of the drill string and through the tool to the drill bit. The drilling fluid is used to cool and lubricate the bit, and to remove debris and rock chips from the borehole, which are created by the drilling process. The drilling fluid returns to the surface, carrying the cuttings and debris, through the annular space between the outer surface of the drill pipe and the inner surface of the borehole.

Tools for moving within downhole passages are often required to operate in harsh environments and limited space. For example, tools used for oil drilling may encounter hydrostatic pressures as high as 16,000 psi and temperatures as high as 300° F. Typical boreholes for oil drilling are 3.5–27.5 inches in diameter. Further, to permit turning, the tool length should be limited. Also, downhole tools must often have the capability to generate and exert substantial force against a formation. For example, operations such as drilling require thrust forces as high as 30,000 pounds.

As a result of the harsh working environment, space constraints, and force generation requirements, downhole tractors are used only in very limited situations, such as within existing well bore casing and smaller diameter open holes. While a number of the inventors of this application have previously developed a significantly improved design for a downhole tractor, further improvements are desirable to achieve performance levels that would permit downhole tractors to achieve commercial success in other environments, such as open bore drilling.

In one known design, a tool for moving within an underground passage comprises an elongated body, a propulsion system for applying thrust to the body, and packerfeet for anchoring the tractor to the inner surface of a borehole or passage while such thrust is applied to the body. Each packerfoot has a bladder having an inflated position in which the bladder grips the inner surface of the passage to substantially prevent relative movement therebetween, and a deflated position in which the bladder permits substantially free relative movement between the bladder and the inner surface of the passage. Typically, each packerfoot is longitudinally slidable with respect to the tool body so that the body can be thrust longitudinally while the packerfoot's bladder is inflated. The exterior surfaces of the bladders are preferably configured so as not to substantially impede "flow-by," the flow of fluid returning from the drill bit up to the ground surface through the annulus between the tool and the borehole surface.

Tools for moving within downhole passages may have at least two packerfeet that can be alternately inflated and deflated to assist the motion of the tool. As used herein, inflating or deflating a packerfoot refers to the inflation or deflation of the bladder of the packerfoot. In one cycle of operation, the body is thrust longitudinally along a first stroke length while a first packerfoot is inflated and a second packerfoot is deflated. During the first stroke length, the second packerfoot moves along the tool body in a reset motion. Then, the second packerfoot is inflated and the first packerfoot is subsequently deflated. The body is thrust longitudinally along a second stroke length. During the second stroke length, the first packerfoot moves along the tool body in a reset motion. The first packerfoot is then inflated and the second packerfoot subsequently deflated. The cycle then repeats. Alternatively, a tool may be equipped with only a single packerfoot for specialized applications of well intervention, such as movement of sliding sleeves or perforation equipment.

Packerfeet are typically powered by fluid, such as drilling mud in an open system or hydraulic fluid in a closed system. Typically, pressurized fluid is delivered to the bladder interior to inflate the bladder. When it is desired to deflate the bladder, the bladder interior is brought into fluid communication with the annulus between the tool and the inner surface of the passage to dispel the fluid to the annulus. Motor-operated or hydraulically controlled valves in the tool body can control the delivery of fluid to and from the bladders.

The inventors of the present application have developed several designs of packerfeet incorporating bladders. One such design is described in U.S. Pat. No. 6,347,674, entitled "ELECTRICALLY SEQUENCED TRACTOR." In this design, the bladder comprises several generally tubular layers of rubber reinforced by fibers, such as fiberglass. The tubular layers are equal in length and arranged concentrically so that the ends of the layers are aligned with one another. Radial exterior surfaces of end portions of the bladder are bonded to rigid tubular members of the downhole tool. Additionally, a plurality of elongated flexible beams or "toes" are bonded to the radial exterior surface of the bladder, for improved torsional rigidity. The toes have a trapezoidal cross-section to permit increased flow-by of drilling fluid through the annulus between the tool and the inner surface of the passage. The ends of the toes are retained against the bladder by two retaining rings, one at each end of the bladder.

SUMMARY OF THE INVENTION

It is an object of the present invention to provide a packerfoot having a bladder assembly configured for longer life and reduced risk of delamination of the bladder from the remainder of the packerfoot.

The present invention provides a packerfoot with a generally tubular bladder having first and second ends each having a plurality of annular steps that mate with and are bonded to annular steps of annuli or bladder attachment portions of the packerfoot. This configuration results in more even distribution of loads from the bladder to the bladder attachment portions, increasing the life of the bladder.

A further aspect of the present invention comprises compressible strain-relief rings utilized in conjunction with a packerfoot having toes retained against a bladder by retaining rings. The strain-relief rings are positioned between the toe ends and the retaining rings. The strain-relief rings permit a degree of outward radial displacement of the toe ends during bladder inflation, thus limiting stress concentrations in the bladder and increasing bladder life.

A still further aspect of the present invention comprises a packerfoot in which the bond length of each end of the bladder to a rigid portion of the packerfoot is chosen so that the ratio of such bond length to the bladder thickness is greater than 25, and more preferably greater than 50. It has been discovered that bond lengths of this magnitude result in unexpectedly high increases in joint efficiency of the bladder to the rigid portions of the packerfoot.

A still further aspect of the present invention comprises a packerfoot in which the total bond length of the bladder to the rigid portions of the packerfoot is greater than or equal to twice the length of the inflatable portion of the bladder. Such proportionality between the total bond length and the length of the inflatable portion has been found to achieve unexpectedly improved resistance to failure. In another aspect, each of the first and second bond lengths is greater than or equal to the length of the inflatable portion of the bladder.

In accordance with one aspect, the present invention provides a gripper for anchoring a tool within, a passage, comprising an elongated mandrel, first and second elongated annuli, and an elongated generally tubular inflatable bladder. The mandrel is adapted to longitudinally slidably engage an elongated body of a tool. The first annulus is engaged with and surrounds a length of the mandrel. An end of the first annulus has a surface facing radially inward and having a plurality of annular steps. Similarly, the second annulus is engaged with and surrounds a length of the mandrel. An end of the second annulus has a surface facing radially inward and having a plurality of annular steps. The bladder has a retracted position in which the gripper permits substantially free relative movement between the gripper and an interior surface of the passage, and an inflated position in which the gripper substantially limits relative movement between the gripper and the interior surface of the passage. A first end of the bladder has a surface facing radially outward and having a plurality of annular steps. A second end of the bladder has a surface facing radially outward and having a plurality of annular steps. The annular steps of the first end of the bladder mate with and are adhered to the annular steps of the first annulus. Similarly, the annular steps of the second end of the bladder mate with and are adhered to the annular steps of the second annulus.

In accordance with another aspect, the present invention provides a gripper for anchoring a tool within a passage, comprising an elongated mandrel, first and second elongated bladder attachment portions or annuli, an elongated generally tubular inflatable bladder, a plurality of flexible beams on a radial exterior of the bladder, a retaining ring, and a strain-relief ring. The mandrel is adapted to longitudinally slidably engage an elongated body of a tool. The first and second bladder attachment portions are slidable with respect to the mandrel. The bladder has a first end bonded to the first bladder attachment portion and a second end bonded to the second bladder attachment portion. The bladder has a retracted position in which the gripper permits substantially free relative movement between the gripper and an interior surface of a passage, and an inflated position in which the gripper substantially limits relative movement between the gripper and the interior surface of the passage.

The beams are oriented generally parallel to the mandrel and have ends positioned radially exterior of the bladder. The retaining ring is positioned radially exterior of the ends of the beams and substantially prevents radial outward movement of such ends of the beams. The strain-relief ring is wedged between the retaining ring and the ends of the beams. Central regions of the beams are configured to flex radially outward to grip a passage surface when the bladder is in the actuated position. The strain-relief ring is configured to compressibly permit a degree of radial outward movement of the ends of the beams as the central regions flex radially outward. In one embodiment, an additional retaining ring and strain-relief ring pair is positioned on the opposite ends of the toes.

In another aspect, the present invention provides a packerfoot for anchoring a tool within a borehole, comprising an elongated mandrel, first and second elongated bladder attachment portions slidable with respect to the mandrel, and an elongated generally tubular inflatable bladder. The mandrel is adapted to longitudinally slidably engage an elongated body of a tool. The bladder has a retracted position in which the bladder permits substantially free relative movement between the packerfoot and an inner surface of a borehole, and an inflated position in which the bladder substantially limits relative movement between the packerfoot and the inner surface of the borehole. The bladder has a first end and a second end. The first end is bonded to the first bladder attachment portion along a first bond length of the bladder. The second end is bonded to the second bladder attachment portion along a second bond length of the bladder. The bladder has an inflatable portion separate from its first and second bond lengths. The sum of the first and second bond lengths of the bladder is greater than or equal to twice the length of the inflatable portion of the bladder.

In yet another aspect, the present invention provides a packerfoot for anchoring a tool within a borehole, comprising an elongated mandrel, first and second elongated bladder attachment portions slidable with respect to the mandrel, and an elongated generally tubular inflatable bladder. The mandrel is adapted to longitudinally slidably engage an elongated body of a tool. The bladder has a retracted position in which the bladder permits substantially free relative movement between the packerfoot and an inner surface of a borehole, and an inflated position in which the bladder substantially limits relative movement between the packerfoot and the inner surface of the borehole. The bladder has a first end and a second end. The first end is bonded to the first bladder attachment portion along a first bond length of the bladder. The second end is bonded to the second bladder attachment portion along a second bond length of the bladder. The bladder has a fiber-reinforced component. Both (1) the ratio of the first bond length of the bladder to the thickness of the fiber-reinforced component and (2) the ratio of the second bond length of the bladder to the thickness of the fiber-reinforced component are greater than 25.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
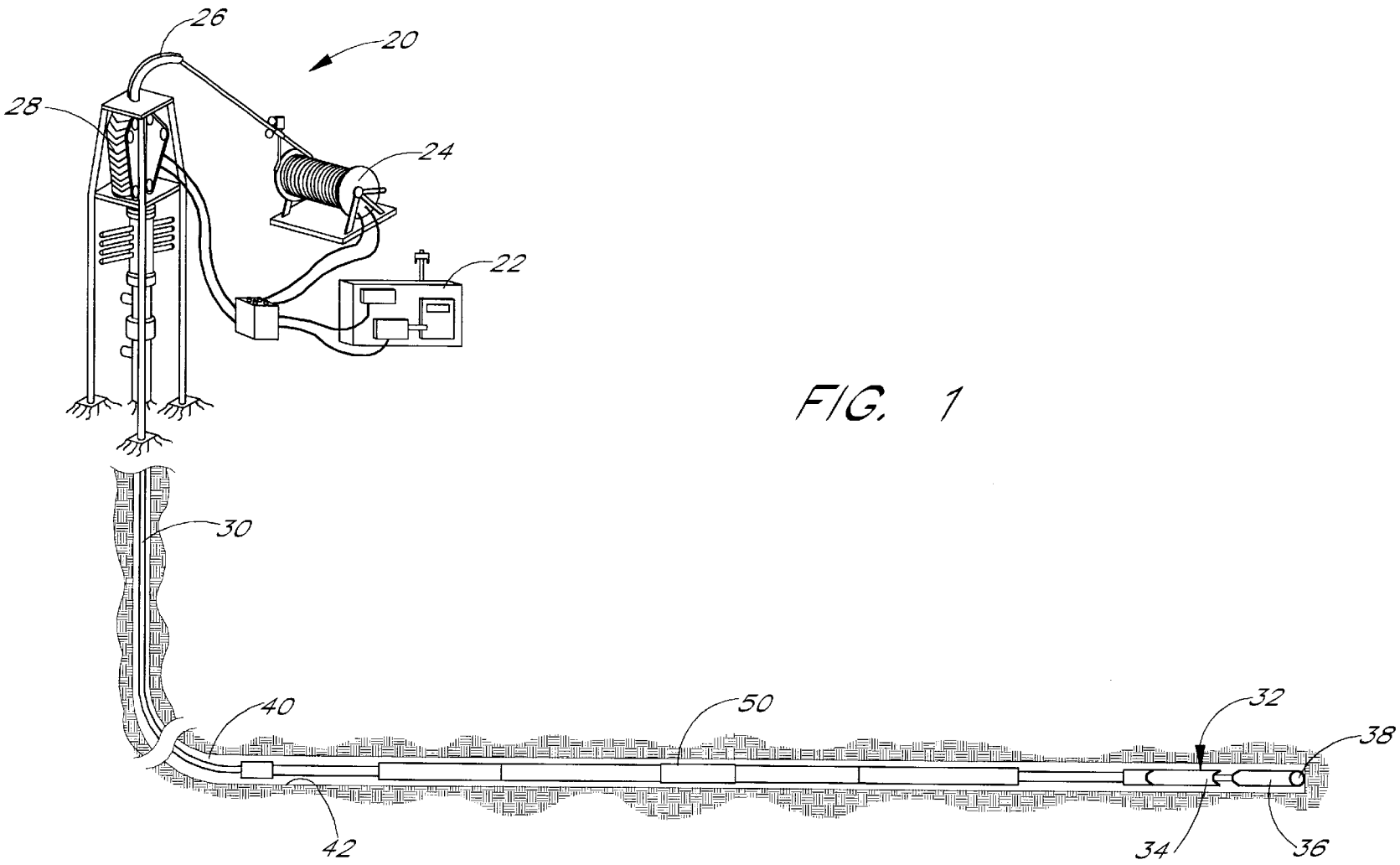
FIG. 1 is a schematic diagram of the major components of a coiled tubing drilling system having packerfeet according to a preferred embodiment of the present invention.

FIG. 1 shows a coiled tubing system 20 for use with a downhole tool 50, such as a tractor, for moving within a passage. The downhole tool 50 has two packerfeet 100A and 100F (FIG. 2) according to the present invention, preferably located near the ends of the tool. Those of skill in the art will understand that any number of packerfeet 100 may be used. The coiled tubing drilling system 20 may include a power supply 22, tubing reel 24, tubing guide 26, tubing injector 28, and coiled tubing 30, all of which are well known in the art. A bottom hole assembly 32 may be assembled with the downhole tool 50. The bottom hole assembly may include a measurement while drilling (MWD) system 34, downhole motor 36, drill bit 38, and various sensors, all of which are also known in the art. The downhole tool 50 is configured to move within a borehole having an inner surface 42. An annulus 40 is defined by the space between the downhole tool 50 and the inner surface 42.

As used herein, a "tool" is a device that is capable of moving within a passage under motive force provided by fluid, such as drilling fluid. A tool may be generally elongated and have packerfeet for gripping onto the inner surface of the passage. A tool may have valves for controlling the flow of fluid to various components of the tool. Such valves may be controlled hydraulically, electrically, electro-hydraulically, or otherwise.

The packerfeet 100 of the present invention may be used with a variety of different downhole tool designs, including, for example, (1) the "PULLER-THRUSTER DOWNHOLE TOOL," shown and described in U.S. Pat. No. 6,003,606 to Moore et al.; (2) the "ELECTRICALLY SEQUENCED TRACTOR," shown and described in U.S. Pat. No. 6,347,674; and (3) the "ELECTRO-HYDRAULICALLY CONTROLLED TRACTOR," shown and described in U.S. Pat. No. 6,241,031, all of which are hereby incorporated herein by reference, in their entirety.

Figure 2:
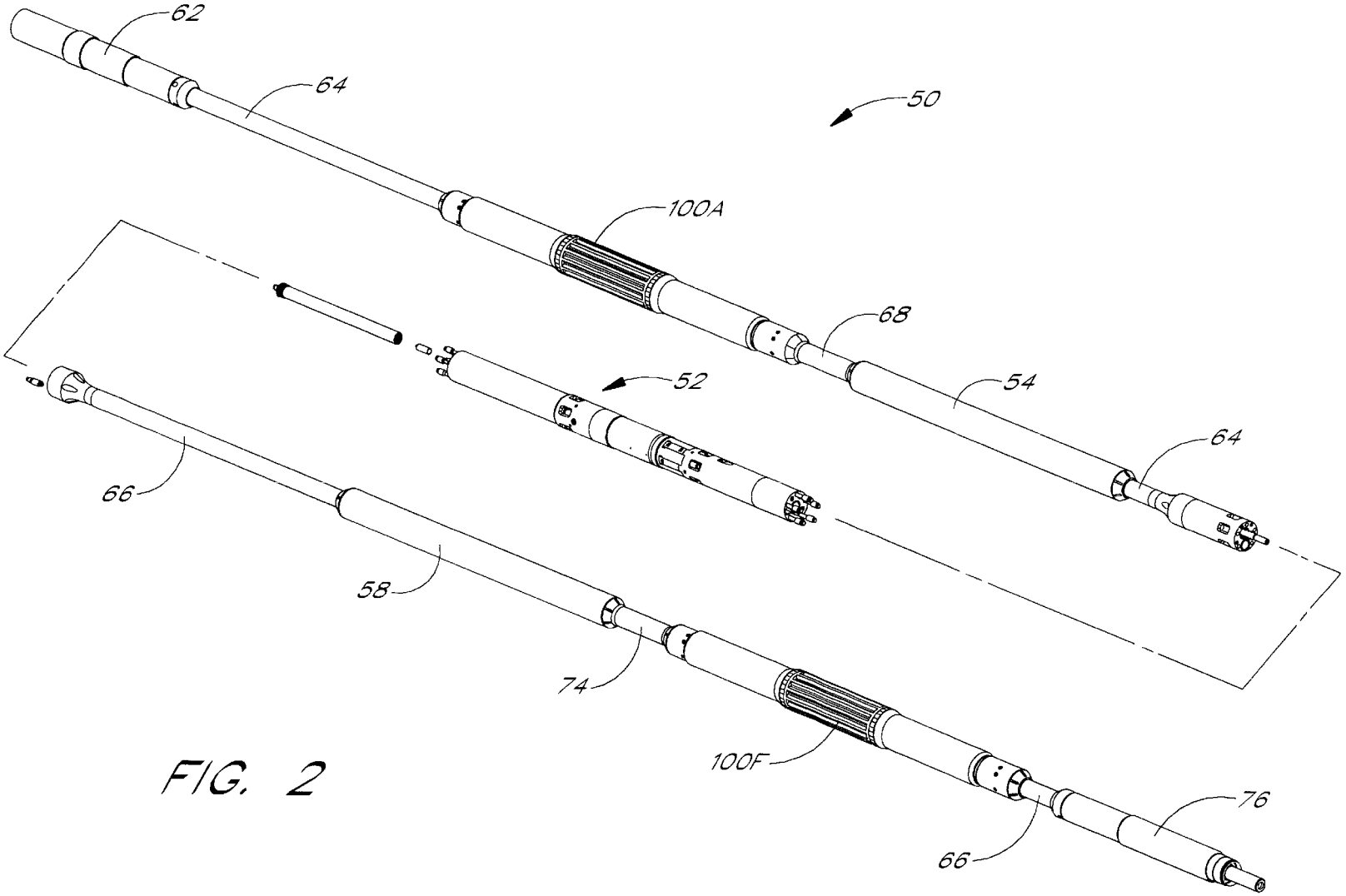
FIG. 2 is a front perspective view of a tractor having packerfeet according to a preferred embodiment of the present invention.

FIG. 2 shows a downhole tool 50 having packerfeet 100A and 100F according to the present invention. The illustrated tool 50 is an Electrically Sequenced Tractor (EST), as identified above. The tool 50 includes a central control assembly 52, an uphole or aft packerfoot 100A, a downhole or forward packerfoot 100F, an aft propulsion cylinder 54, a forward propulsion cylinder 58, a drill string connector 62, shafts 64 and 66, flexible connectors 68 and 74, and a bottom hole assembly connector 76. The drill string connector 62 connects a drill string, such as the coiled tubing 30 (FIG. 1), to the shaft 64. The aft packerfoot 100A, aft propulsion cylinder 54, and connector 68 are assembled together end to end and are all axially slidably engaged with the shaft 64. Similarly, the forward packerfoot 100F, forward propulsion cylinder 58, and connector 74 are assembled together end to end and are slidably engaged with the shaft 66. The connector 76 provides a connection between the tool 50 and downhole equipment such as a bottom hole assembly. The shafts 64 and 66 and the control assembly 52 are axially fixed with respect to one another and are sometimes referred to herein as the body of the tool 50. The body of the tool 50 is thus axially fixed with respect to the drill string and the bottom hole assembly.

As used herein, "aft" refers to the uphole direction or portion of an element in a passage, and "forward" refers to the downhole direction or portion of an element. When an element is removed from a downhole passage, the aft end of the element emerges from the hole before the forward end.

Figure 3:
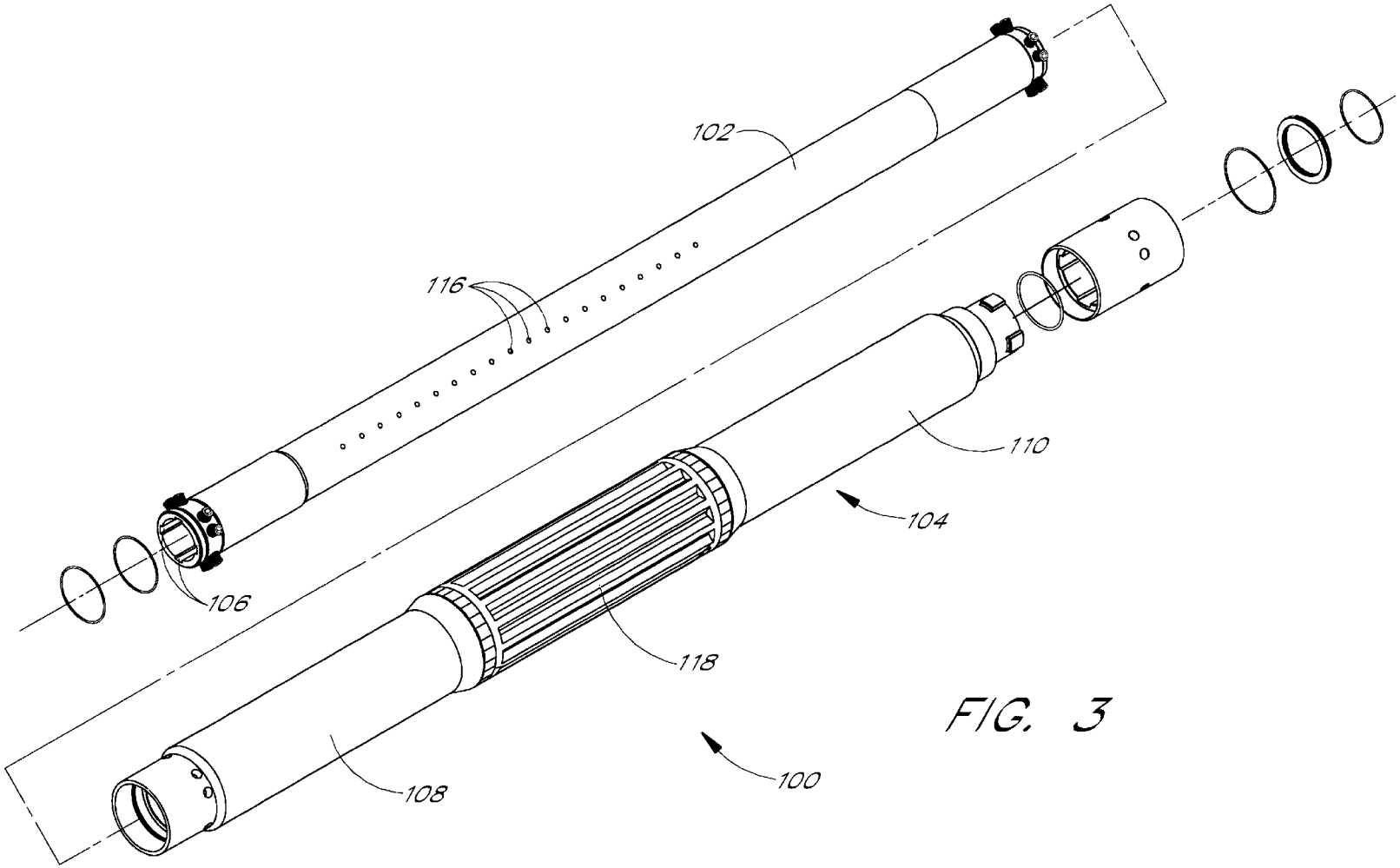
FIG. 3 is a rear perspective view of a partially disassembled packerfoot according to a preferred embodiment of the present invention.

FIG. 3 shows a packerfoot 100 according to one embodiment of the present invention. The packerfoot 100 comprises a mandrel 102 and a bladder assembly 104. The mandrel 102 is generally tubular and preferably has internal grooves 106 sized and configured to slidably engage rotation restraints on the body of a downhole tool, so that the mandrel 102 can slide longitudinally but cannot rotate with respect to the tool body. The bladder assembly 104 includes generally rigid bladder attachment portions (or "annuli") 108 and 110 attached to each end of a generally tubular inflatable bladder 112 (FIG. 4) enclosed by a bladder cover 118. The assembly 104 may enclose a substantial portion if not all of the length of the mandrel 102. As used herein, "annulus" (or "annuli") refers to a ringlike portion (or portions) that surrounds a length of the mandrel 102. The use of "annulus" herein does not necessarily imply an exactly circularly shaped member.

Preferably, one of the bladder attachment portions 108 and 110 is longitudinally or absolutely fixed with respect to the mandrel 102 and the other is longitudinally or absolutely slidable with respect to the mandrel. When the bladder 112 is inflated, this configuration permits the sliding bladder attachment portion to move longitudinally toward the fixed bladder attachment portion to allow enhanced radial expansion of the bladder. The packerfoot 100 can preferably traverse holes up to 50% larger than the drill bit without losing traction. Further, such a configuration reduces the amount of stretching of the bladder 112, which tends to prevent fibers in the bladder from overstraining. In other embodiments, both bladder attachment portions can be longitudinally or absolutely fixed with respect to the mandrel, or both bladder attachment portions can be longitudinally or absolutely slidable with respect to the mandrel.

In a preferred embodiment, the aft bladder attachment portion 108 is fixed with respect to the mandrel 102, and the forward bladder attachment portion 110 is slidable with respect to the mandrel. In this configuration, the portions 108 and 110 tend to remain separated as the tool 50 is pulled out of a hole, minimizing any impedance caused by undesired expansion of the bladder. Alternatively, the forward bladder attachment portion 110 can be fixed with respect to the mandrel 102 and the aft bladder attachment portion 108 slidable with respect to the mandrel. In further alternatives, the portions 108 and 110 can be both fixed or both slidable with respect to the mandrel 102. One or both of the portions 108 and 110 can be directly fixed to the mandrel 102 or fixed to an intermediate member that is fixed with respect to the mandrel. Preferably, the sliding bladder attachment portion (s) are prevented from rotating with respect to the mandrel 102, such as by a tongue and groove engagement therewith. This prevents undesired twisting of the bladder and resultant rotation of the tool body when the bladder is inflated.

Figure 4:
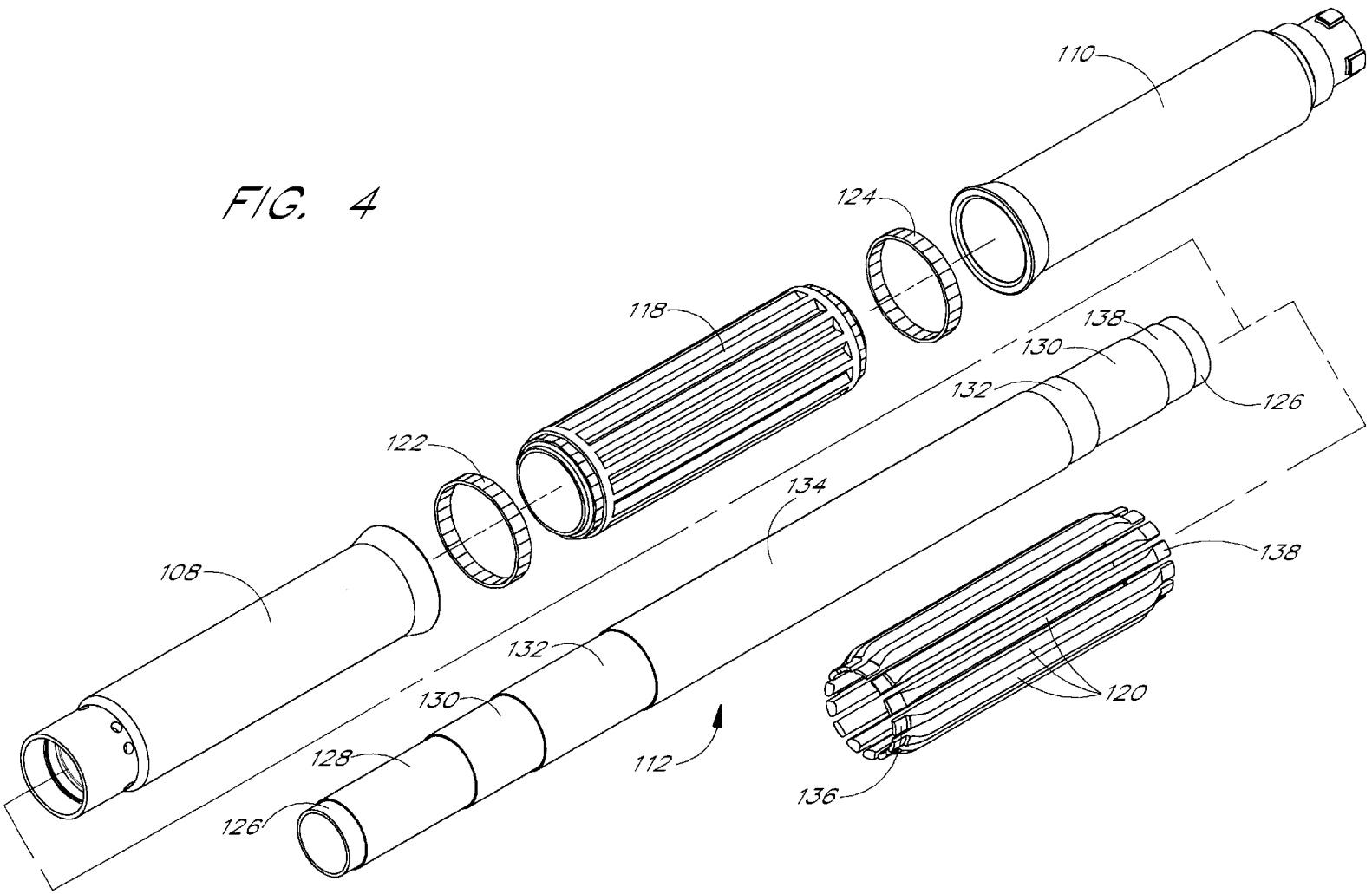
FIG. 4 is a rear perspective view of a bladder assembly of the packerfoot of FIG. 3, in disassembled form.

One or more fluid ports 116 are provided along a length of the mandrel 102, which communicate with the interior of the bladder 112 (FIG. 4). The ports 116 are preferably arranged about the circumference of the mandrel 102, so that fluid is introduced uniformly throughout the bladder interior. Suitable fluid seals, such as rubber O-rings, are provided at the ends of the packerfoot 100 between the bladder attachment portions 108 and 110 and the mandrel 102 to prevent fluid within the bladder 112 from leaking out to the annulus between the tool 50 and the passage surface.

FIG. 4 shows a bladder assembly 104 of a packerfoot 100, in disassembled form. The bladder assembly 104 comprises the bladder attachment portions 108 and 110, a bladder 112, a bladder cover 118, flexible beams or toes 120, and retaining rings 122 and 124. In the preferred embodiment, the bladder 112 comprises a balanced laminate of multiple generally tubular concentric layers of fiber-reinforced rubber. In the illustrated embodiment, the bladder 112 comprises five layers 126, 128, 130, 132, and 134. The radially innermost layer 126 is the longest and has the smallest diameter. The layers 128, 130, 132, and 134 are successively shorter and larger in diameter. The layers are preferably arranged so that the ends of the bladder 112 form annular steps as shown. In other words, from the center of the bladder 112 to either end, the diameter of the bladder decreases in a series of annular steps until it reaches the diameter of the innermost layer of the bladder. Those of ordinary skill in the art will understand that the bladder 112 can comprise any number of layers. However, the bladder preferably comprises at least three layers.

Preferably, the bladder 112 comprises fiber-reinforced rubber, for increased strength and fatigue life. In a preferred embodiment, all of the layers except for the innermost layer 126 of the bladder 112 are formed from fiber-reinforced rubber, with the layer 126 being formed only of rubber. The innermost layer 126 is used as a sealing surface from the inflation fluid. A preferred reinforcing fiber is fiberglass, preferably S-glass, due to its high strength, fatigue life, and ease of bonding to rubber. S-glass fibers, available from Asahi Corp., Japan, have high strength (530,000 psi) and high elongation (5–6%). However, other fibers can alternatively be used, including E-glass, nylon, Nomex, steel wire, Kevlar (polyamides), and various graphites. Nylon and Nomex can be used for packerfeet designed for reduced load applications, due to such materials' lower strength. Advantageously, these fibers tend to plastically deform at loads just below their failure thresholds. Such elastic-plastic behavior minimizes stress concentrations and results in longer life of the bladder. Steel wire can be used, but preferably not in downhole tools that utilize magnetic sensors, since the steel tends to electromagnetically interfere with the sensor operation.

The rubber component of the bladder may be NBR (nitrile butadiene rubber), HNBR, TFE (tetra-fluor-ethylene) rubber (such as AFLAS), or others. A preferred rubber is HNBR. Additives may be added to the rubber to improve abrasion resistance or reduce hysterisis, such as carbon, oil, plasticizers, and various coatings including bonded Teflon-type materials. The fibers are preferably bonded to the rubber. In one embodiment, S-glass fibers are bonded to the rubber with the use of an RFL coating. RFL is a latex formulation provided by NBF-Canada, Ltd., Ontario, Canada. The various layers and fibers of the bladder 112 can be layed up by hand and cured together.

In a preferred embodiment, each layer of the bladder 112 includes fibers oriented at an angle with respect to the longitudinal axis of the tool 50. More preferably, the orientations of the fibers in adjacent layers alternate direction with respect to the longitudinal axis of the tool. For example, the layer 128 (FIG. 4) can include fibers oriented at +15° with respect to the longitudinal axis of the tool 50, with the layer 130 having fibers oriented at −15°, the layer 132 having fibers oriented at +15°, and the layer 134 having fibers oriented at −15°. The bias angles are preferably within 0–90°, and more preferably within 10–30°, relative to the longitudinal axis of the tool. The bias angles can be varied between pairs of layers. For example, the layers 128 and 130 can have fibers oriented at +15° and −15°, respectively, with the layers 132 and 134 having fibers oriented at +20° and −20°, respectively. Those of ordinary skill in the art will understand that there are many different possible combinations of fiber orientations among the various layers of the bladder 112. The orientations of the various fibers can be chosen to produce a desired bladder expansion capability and life performance.

The bladder cover 118 lies concentrically on the radial exterior of the bladder 112. The purpose of the bladder cover 118 is to provide a protective coating for the fiber-reinforced layers to assist in holding the toes into position, and to provide an inner sealing surface. In some embodiments of the invention, the bladder cover 118 is omitted from the packerfoot 100. In the illustrated embodiment, the toes 120 are positioned on the radial exterior of the bladder cover 118. Preferably, the toes 120 are bonded to the bladder cover 118 or directly to the bladder 112 if the bladder cover is omitted. A bonding agent such as RFL may be used. The bonding is achieved by the rubber during the fabrication process. Any number of toes 120 may be provided, keeping in mind various operational parameters, including required collapsed diameter, required expanded diameter, type of rock formation, torque, thrust, and operating pressure. In the illustrated embodiment, thirteen toes 120 are provided. In the preferred embodiment, the toes 120 are spaced generally equidistantly about the perimeter of the bladder.

The ends of the toes 120 are preferably flattened, as at 136 and 138. The retaining rings 122 and 124 are adapted to fit relatively snugly over the flattened portions 136 and 138, respectively, of the ends of the toes. The retaining rings 122 and 124 substantially constrain the ends of the toes 120 from being displaced radially outward. Without the retaining rings 122 and 124, the ends of the toes 120 may tend to delaminate from the bladder cover 118. This could cause the toe ends to get caught onto the inner surface of the borehole and impede removal of the tool therefrom. As described below in connection with FIGS. 6 and 7, strain-relief rings 142 and 143 of compressible material may be positioned between the ends of the toes 120 and the retaining rings 122 and 124.

When the bladder 112 is inflated to grip onto the inner surface of a borehole, it is desirable that the bladder not block the uphole return flow of drilling fluid and drill cuttings in the annulus between the tool 50 and the borehole surface. To prevent this, the toes 120 may have a triangular or trapezoidal cross-section. The toes 120 are preferably trapezoidal in cross-section, with the base of the trapezoid being bonded to the bladder cover 118 and the top of the trapezoid adapted to contact the inner surface of the borehole. The toes' cross-sectional properties are preferably optimized for long fatigue life, based upon expected operational stresses and material properties. The cross-sectional shapes were determined by finite element stress analyses under estimated operational parameters, including degree of flexure caused by bladder inflation, thrust-pull of the tool, and torque. The stress (or strain) results are included into an appropriate failure criterion for the toe's materials. The projected life is determined by including the stress (or strain) results into an appropriate failure criterion for the toe's materials. Fatigue life estimates for the toe materials are based on information provided commercially from vendors. Specifically, fatigue life data for toes made from copper-beryllium is provided by Brush-Wellman Corporation of Cleveland, Ohio.

When the bladder 112 grips onto the inner surface of a borehole, crevices are formed between the toes 120 and the borehole surface, permitting the flow of drilling fluid and drill cuttings past the packerfoot. The toes 120 are preferably designed to be (1) sufficiently large to provide traction against the borehole surface, (2) sufficiently small in cross-section to minimize impedance of uphole return flow of drilling fluid and drill cuttings past the packerfoot 100 in the annulus, (3) appropriately flexible to deform during the inflation of the bladder 112, and (4) elastic to assist in the expulsion of fluid from the packerfoot during deflation. Preferably, each toe 120 has an outer radial width of 0.1–0.6 inches and a modulus of elasticity of about 19,000,000 psi.

Figure 5:
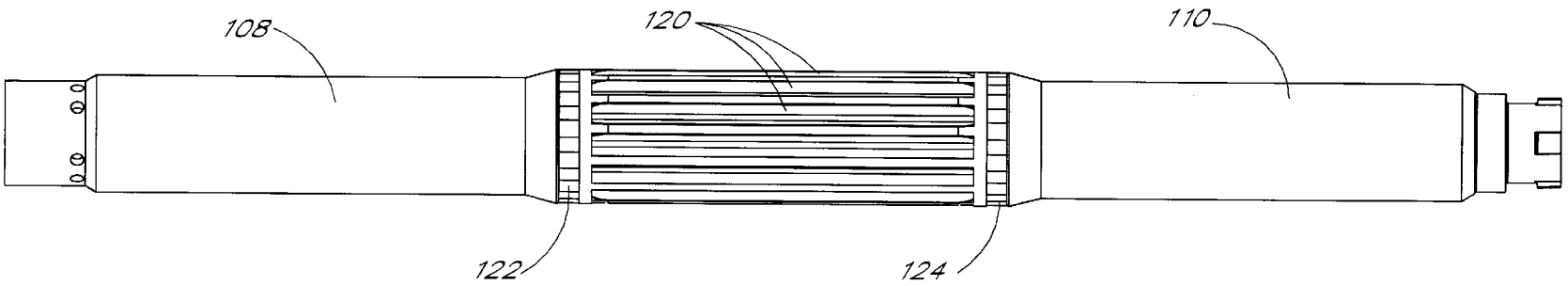
FIG. 5 is a side view of the bladder assembly of FIG. 4, in assembled form.
Figure 6:
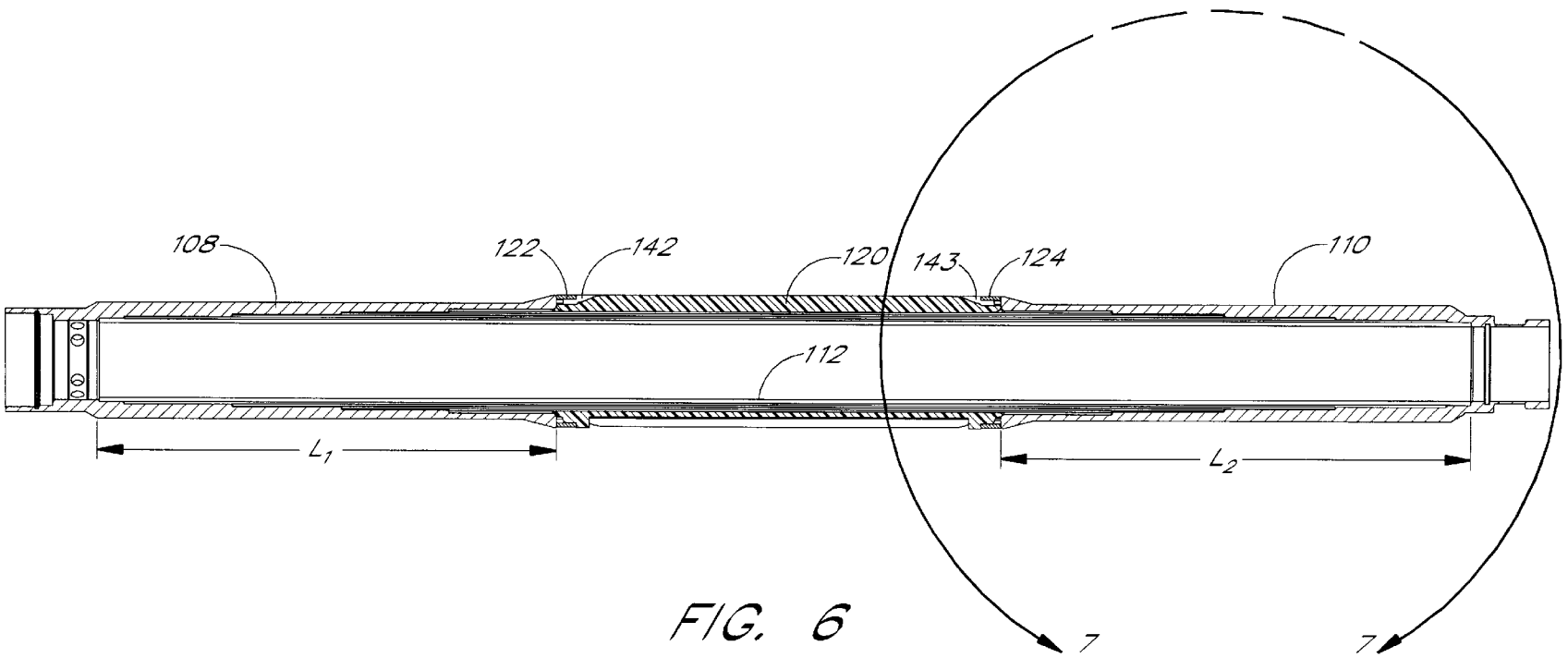
FIG. 6 is a longitudinal sectional view of the bladder assembly shown in FIG. 5.
Figure 7:
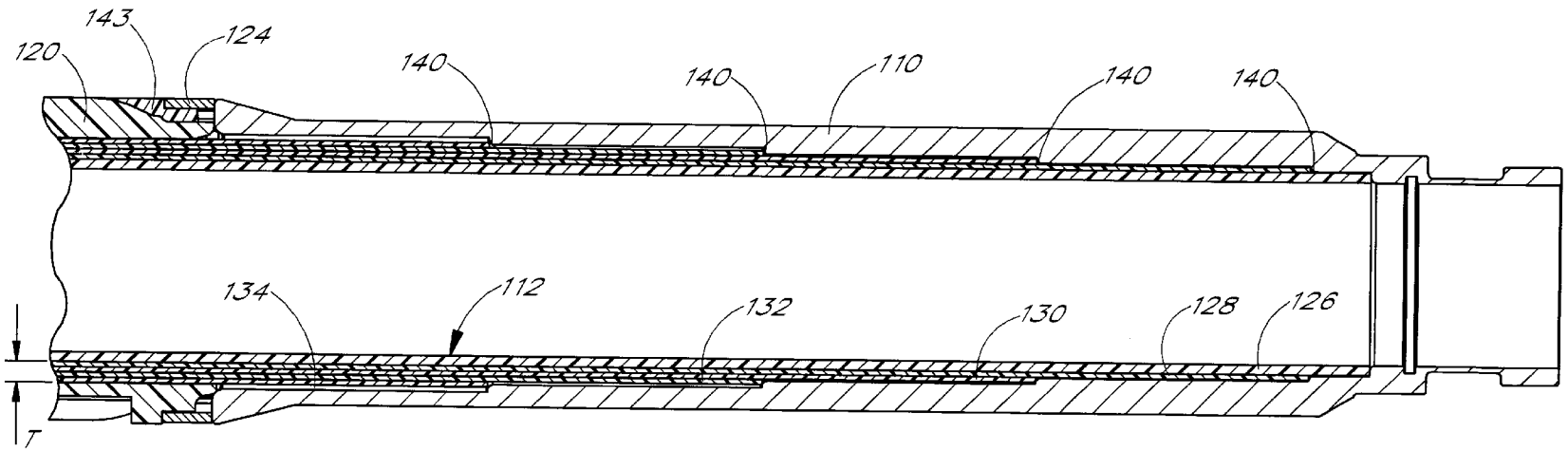
FIG. 7 is an exploded view of the forward end of the bladder assembly of FIG. 6.

As shown in FIGS. 4–6, the length of each of the bladder attachment portions 108 and 110 is approximately equal to that of the inflatable portion of the bladder I 12, the toes 120, and the bladder cover 118. As shown in FIGS. 6 and 7, the outer radial surfaces of the aft and forward portions of the bladder 112 are bonded to the inner radial surfaces of the bladder attachment portions 108 and 110, respectively. The inner surfaces of the bladder attachment portions 108 and 110 have a plurality of annular steps 140 that match and conform to the annular steps formed by the layers of the bladder 112. Such a multi-stepped configuration results in more efficient bonding of the bladder 112 to the bladder attachment portions 108 and 110. It also results in more uniform distribution of the load from the bladder 112 to the portions 108 and 110.

Preferably, the shortest layer of the bladder 112 (layer 134 in the illustrated embodiment) is longer than the toes 120 and bladder cover 118 and is bonded to the attachment portions 108 and 110. The thickness of the innermost layer of the bladder (layer 126 in the illustrated embodiment) is preferably at least 0.090 inches, and more preferably at least 0.120 inches. Such a thickness of the innermost layer provides resistance to tearing of the bladder 112 at or near the termination of the fiber-reinforced layers. Such tearing of the bladder could be caused, for example, by hyper-pressurization of the bladder.

Preferably, the bond length of the bladder 112 to the bladder attachment portions is selected based upon the thickness of the fiber-reinforced portion of the bladder and the material qualities of the bladder attachment portions. In particular, the ratio of the bond length at each end of the bladder 112 to the thickness of the fiber-reinforced portion of the bladder is preferably greater than 16 and more preferably greater than 50. FIGS. 6 and 7 illustrate this concept. With reference to FIG. 6, the distance $L_1$ represents the bond length of the aft end of the bladder 112 to the aft bladder attachment portion 108. The distance $L_2$ represents the bond length of the forward end of the bladder to the forward bladder attachment portion 110. With reference to FIG. 7, the distance T represents the thickness of the fiber-reinforced portion of the bladder. The values of $L_1$ and T determine the "joint efficiency" of the bond between the bladder 112 and the aft bladder attachment portion 108, and the values of $L_2$ and T determine the joint efficiency of the bond between the bladder and the forward bladder attachment portion 110. Joint efficiency (E) is a measure of the quality of a bond, having a value ranging from 0–100%. A joint efficiency of 100% represents a perfect bond, equivalent to an integral or homogenous connection. The concept of "joint efficiency" is known to those of skill in the art.

Experiments have shown that for bladder attachment portions formed of copper-beryllium alloy, a bladder end having an L/T ratio (e.g., $L_1/T$ or $L_2/T$) of 16 has a joint efficiency of approximately 12%. Prior art packerfeet have had L/T ratios as high as 16 at the ends of the bladder. However, when the bond length at an end of the bladder is increased so that the L/T ratio at the bladder end is 50 (a factor of 3.125), the joint efficiency at the bladder end increases to 50% (a factor of 4.17). Thus, the relationship between L/T and E at a bladder end is non-linear and unexpected.

To further illustrate the unexpected bond strength achieved by lengthening the bond lengths at the ends of the bladder, consider the relationship between the burst pressure of the packerfoot of the present invention and the L/T ratios at the bladder ends. The burst pressure is the pressure at which the bonds between the bladder and the bladder attachment portions fail. The burst pressure is dependent upon the shortest bond length between $L_1$ and $L_2$. Tests have shown that an increase of the $L_s/T$ ratio (where $L_s$ is the lesser of $L_1$ and $L_2$) from 14 to 52 produces an increase in burst pressure from 450 psi to 2350 psi, a 17% increase over expected burst pressure performance. For the illustrated configuration of the packerfoot of the present invention, the following empirical relationship was determined:

$$P_B = 13.08\ (L_s/T)^{1.315}$$

where $P_B$=burst pressure of the bladder $L_s$=shorter of the two bond lengths of the bladder, i.e., the shorter of $L_1$ and $L_2$ T=thickness of the fiber-reinforced component of the bladder Preferably the ratios $L_1/T$ and $L_2/T$ of the bladder of the packerfoot of the present invention are both greater than 25, more preferably both greater than 50, and even more preferably both greater than 55. $L_s/T$ ratios of 25, 50, and 55 provide unexpectedly high yet desirable burst pressures of about 900, 2250, and 2550 psi, respectively. It is anticipated that burst pressures of these magnitudes or greater will be particularly desirable, so that the bladders can provide sufficient gripping force to prevent slippage of the tractor with respect to a borehole during expected downhole operations at required thrust/pull requirements. For example, while drilling through harder rock formations, it is expected that a tractor may be required to provide thrusting forces as high as 12,708 pounds. In order to prevent slippage during such operations, it is expected that the burst pressures of the bladders will be required to be at least 2250 psi (corresponding to a $L_s/T$ ratio of 50), and more preferably at least 2550 psi (corresponding to a $L_s/T$ ratio of 55). Even a burst pressure of at least 900 psi (corresponding to a $L_s/T$ ratio of 25) is expected to permit operations at significantly higher loads than prior art packerfeet.

The total bond length ($L_1+L_2$) of the bladder 112 to the bladder attachment portions 108 and 110 is preferably greater than or equal to twice the length of the inflatable portion of the bladder. In other words, the unbonded, inflatable portion of the bladder (total length of the bladder minus $L_1$ and minus $L_2$) is preferably less than one-third of the total length of the bladder. The bond length at each end of the bladder, i.e., $L_1$ and $L_2$, is preferably greater than or equal to the length of the inflatable portion of the bladder. Under these conditions, the risk of delamination of the bladder from the bladder attachment portions is minimized. Experimental results with packerfeet of three different bond lengths have shown that when the bonded area is increased the burst pressure of a packerfoot increases more than expected.

According to the invention, the bond length of the bladder is increased over prior art designs. Analytical estimates of the bond strength of the glass fiber-reinforced bladder to the bladder attachment portions were initially based upon literature about glass fiber and glass-rubber bonding technology, developed primarily in the tire industry. It was anticipated that the shear (pull-out) strength of fiberglass in a rubber composite would be approximately equal to the shear strength of the rubber (2000–3000 psi). However, unlike automobile tires, which are continuous structures, packerfoot bladders have end terminations. After extensive testing, it was discovered that the best shear strength actually delivered to the packerfeet was 400–1600 psi. Thus, the actual capacity of a rubber-glass composite is 25%–85% less than expected from literature predictions. The increased bond length according to the present invention counteracts these problems. Further, the increased bond length also reduces the tendency of the bond to be weakened by handling and manufacturing procedures.

As shown in FIGS. 6 and 7, strain-relief rings 142 and 143 are positioned between the retaining rings and the toes 120. In particular, the strain-relief ring 142 is positioned between the aft ends of the toes 120 and the retaining ring 122 (FIG. 4), and the strain-relief ring 143 is positioned between the forward ends of the toes 120 and the retaining ring 124. The rings 142 and 143 are formed of a compressible material, such as rubber. During inflation of the bladder 112, the central portions of the toes 120 flex radially outward. The ends of the toes 120 are oriented at an angle with respect to the bladder 112. Without the strain-relief rings 142 and 143, the ends of the toes 120 tend to "dig" into the bladder 112. This produces a stress concentration in the bladder and promotes delamination of the bladder from the bladder attachment portions 108 and 110. The strain-relief rings 142 and 143 reduce the risk of delamination of the bladder 112 from the portions 108 and 110 by permitting a certain degree of outward radial displacement of the ends of the toes 120 toward the retaining rings 122 and 124. Thus, the strain-relief rings facilitate smooth and efficient transfer of stress and strain from the toes 120 into the bladder 112. The strain-relief rings cause the loads from the toes 120 to be more evenly distributed into the bladder 112, resulting in greater fatigue life. It is not necessary that the strain-relief rings directly contact the retaining ring is and/or the ends of the toes. It is only necessary that the strain-relief rings be wedged between the retaining rings and the toe ends.

The materials from which the packerfoot 100 is formed may vary depending upon size and the types of sensors used by the downhole tool 50. If magnetic sensors are utilized, such as magnetometers for sensing displacement, then the materials of the packerfoot (and for that matter of the tool 50 as a whole) are preferably non-magnetic, so as to prevent any possibility of interference with sensor operation. A preferred non-magnetic material for the bladder attachment portions 108 and 110 and the toes 120 is copper-beryllium (CuBe) alloy. For other applications, suitable materials include Inconel, steel, CuBe, stainless steel, or other suitable high strength, temperature resistant, long life alloys. The retaining rings 122 and 124 are preferably formed of a high strength non-magnetic material such as Inconel 718.

The packerfoot of the present invention provides several advantages over prior art packerfeet. One advantage is longer fatigue life. The packerfoot of the invention can withstand greater than 10,000 cycles or 100 hours of continuous downhole operation. Another advantage is increased reliability resulting from the reduction of loads required to be carried by the bladder. Another advantage is greater torque-carrying capability resulting from the reinforcing of the toes. The torque is efficiently transferred from the downhole tool 50 through the mandrel 102 and the toes 120 into the borehole formation. Also, the packerfoot 100 described above can be installed immediately into existing downhole tools (e.g., an EST) without retrofitting.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A gripper for anchoring a tool within a passage, comprising:

an elongated mandrel adapted to longitudinally slidably engage an elongated body of a tool;

a first elongated annulus engaged with and surrounding a first elongated portion of said mandrel, an end of said first annulus having a first surface facing radially inward and having a plurality of annular steps;

a second elongated annulus engaged with and surrounding a second elongated portion of said mandrel, an end of said second annulus having a second surface facing radially inward and having a plurality of annular steps; and an elongated generally tubular inflatable bladder having a retracted position in which said gripper permits substantially free relative movement between said gripper and an interior surface of said passage, and an inflated position in which said gripper substantially limits relative movement between said gripper and said interior surface of said passage, said bladder having a first end having a third surface facing radially outward and having a plurality of annular steps, said bladder having a second end having a fourth surface facing radially outward and having a plurality of annular steps, said annular steps of said first end of said bladder mating with and being adhered to said annular steps of said first annulus, said annular steps of said second end of said bladder mating with and being adhered to said annular steps of said second annulus.

2. The gripper of claim 1, wherein said bladder comprises a plurality of generally tubular concentric layers of inflatable material adhered together, said annular steps of said bladder being formed by ends of said layers of material.

3. The gripper of claim 1, wherein one or more of said layers of material comprise fiber-reinforced rubber.

4. The gripper of claim 3, wherein said fiber-reinforced rubber comprises HNBR reinforced by S-glass fibers.

5. The gripper of claim 3, wherein all of said layers except for a radially innermost layer comprise fiber-reinforced rubber, said radially innermost layer being substantially without reinforcing fibers.

6. The gripper of claim 2, said layers of inflatable material having first ends enclosed by said first annulus and second ends enclosed by said second annulus.

7. The gripper of claim 2, wherein said plurality of layers of inflatable material consists of five layers of said inflatable material.

8. The gripper of claim 2, wherein said layers decrease in length from a radially innermost layer to a radially outermost layer.

9. The gripper of claim 2, wherein said layers of material are bonded together with RFL coating.

10. The gripper of claim 1, wherein said first annulus is longitudinally fixed with respect to said mandrel and said second annulus is longitudinally slidable with respect to said mandrel.

11. A gripper for anchoring a tool with in a passage, comprising:

an elongated mandrel adapted to longitudinally slidably engage an elongated body of a tool;

a first elongated annulus engaged with and surrounding a first length of said mandrel;

a second elongated annulus engaged with and surrounding a second length of said mandrel;

an elongated generally tubular inflatable bladder having a first end bonded to said first annulus and a second end bonded to said second annulus, said bladder having a retracted position in which said gripper permits substantially free relative movement between said gripper and an interior surface of a passage, and an inflated position in which said gripper substantially limits relative movement between said gripper and said interior surface of said passage;

a plurality of flexible beams on a radial exterior of said bladder, said beams oriented generally parallel to said mandrel, said beams having first ends and second ends positioned on a radial exterior surface of said bladder;

a first retaining ring on the radial exterior of said first ends of said beams, said first retaining ring limiting radial outward movement of said first ends of said beams;

a second retaining ring on the radial exterior of said second ends of said beams, said second retaining ring limiting radial outward movement of said second ends of said beams;

a first strain-relief ring formed of a compressible material and positioned between said first retaining ring and said first ends of said beams; and a second strain-relief ring formed of a compressible material and positioned between said second retaining ring and said second ends of said beams;

wherein central regions of said beams are configured to flex radially outward to grip a passage surface when said bladder is in said inflated position, said first and second strain-relief rings configured to compress to permit a degree of radial outward movement of said first and second ends of said beams as said central regions flex radially outward.

12. The gripper of claim 11, wherein said first annulus is longitudinally fixed with respect to said mandrel, and said second annulus is longitudinally slidable with respect to said mandrel.

13. The gripper of claim 11, wherein annular steps are formed (i) in a radially interior surface of an end of said first annulus, (ii) in a radially interior surface of an end of said second annulus, (iii) in a radially exterior surface of said first end of said bladder, and (iv) in a radially exterior surface of said second end of said bladder, said annular steps of said first end of said bladder mating with and being adhered to said annular steps of said first annulus, said annular steps of said second end of said bladder mating with and being adhered to said annular steps of said second annulus.

14. A gripper for anchoring a tool within a passage, comprising:

an elongated mandrel adapted to longitudinally slidably engage an elongated body of a tool;

a first elongated bladder attachment portion engaged with said mandrel;

a second elongated bladder attachment portion engaged with said mandrel;

an elongated generally tubular inflatable bladder having a first end bonded to said first bladder attachment portion and a second end bonded to said second bladder attachment portion, said bladder having a retracted position in which said gripper permits substantially free relative movement between said gripper and an interior surface of a passage, and an inflated position in which said gripper substantially limits relative movement between said gripper and said interior surface of said passage;

a plurality of flexible beams on a radial exterior of said bladder, said beams oriented generally parallel to said mandrel, said beams having ends positioned radially exterior of said bladder;

a retaining ring positioned radially exterior of said ends of said beams, said retaining ring substantially preventing radial outward movement of said ends of said beams;

a strain-relief ring wedged between said retaining ring and said ends of said beams; and wherein central regions of said beams are configured to flex radially outward to grip the passage surface when said bladder is in said inflated position, said strain-relief ring configured to compressibly permit a degree of radial outward movement of said ends of said beams as said central regions flex radially outward.

15. The gripper of claim 14, wherein at least one of said bladder attachment portions is longitudinally fixed with respect to said mandrel.

16. The gripper of claim 15, wherein both of said bladder attachment portions are longitudinally fixed with respect to said mandrel.

17. The gripper of claim 14, wherein both of said bladder attachment portions are longitudinally slidable with respect to said mandrel.

18. A packerfoot for anchoring a tool within a borehole, comprising:

an elongated mandrel adapted to longitudinally slidably engage an elongated body of a tool;

a first elongated bladder attachment portion slidable with respect to said mandrel;

a second elongated bladder attachment portion slidable with respect to said mandrel; and an elongated generally tubular inflatable bladder having a retracted position in which said bladder permits substantially free relative movement between said packerfoot and an inner surface of a borehole, and an inflated position in which said bladder substantially limits relative movement between said packerfoot and said inner surface of said borehole, said bladder having a first end and a second end, said first end bonded to said first bladder attachment portion along a first bond length of said bladder, said second end bonded to said second bladder attachment portion along a second bond length of said bladder, said bladder having an inflatable portion separate from said first and second bond lengths of said bladder;

wherein the sum of said first and second bond lengths of said bladder is greater than or equal to twice the length of said inflatable portion of said bladder.

19. The packerfoot of claim 18, wherein each of said first and second bond lengths is greater than or equal to the length of said inflatable portion of said bladder.

20. The packerfoot of claim 18, wherein each of said bladder attachment portions surrounds a length of said mandrel.

21. The packerfoot of claim 18, further comprising a plurality of elongated flexible toes bonded to a radial exterior of one of said bladder and a cover surrounding at least a portion of said bladder, said toes being oriented generally parallel to said mandrel and being configured to flex radially outward so that center regions of said toes are radially displaced.

22. The packerfoot of claim 21, wherein said toes are spaced generally equidistantly about the perimeter of said bladder.

23. The packerfoot of claim 18, wherein said first bladder attachment portion is bonded to a radial exterior surface of said first end of said bladder, said second bladder attachment portion being bonded to a radial exterior surface of said second end of said bladder.

24. The packerfoot of claim 18, wherein said first bladder attachment portion is longitudinally fixed with respect to said mandrel and said second bladder attachment portion is longitudinally slidable with respect to said mandrel, permitting relative longitudinal displacement of said first and second ends of said bladder.

25. The packerfoot of claim 18, wherein both of said bladder attachment portions are longitudinally slidable with respect to said mandrel.

26. The packerfoot of claim 18, wherein both of said bladder attachment portions are longitudinally fixed with respect to said mandrel.

27. The packerfoot of claim 18, wherein said bladder comprises fiber-reinforced rubber.

28. The packerfoot of claim 27, wherein said bladder comprises HNBR reinforced by S-glass fibers.

29. The packerfoot of claim 18, wherein said bladder comprises a plurality of generally tubular concentric layers of rubber.

30. The packerfoot of claim 29, said layers of rubber having first ends enclosed by said first bladder attachment portion and second ends enclosed by said second bladder attachment portion.

31. The packerfoot of claim 29, wherein said layers of rubber are bonded together.

32. The packerfoot of claim 29, wherein said layers of rubber decrease in length from a radial interior layer to a radial exterior layer.

33. The packerfoot of claim 32, wherein said radial interior layer comprises rubber and the remainder of said layers comprise fiber-reinforced rubber.

34. The packerfoot of claim 33, wherein said radial interior layer comprises HNBR, the remainder of said layers comprising HNBR reinforced by S-glass fibers.

35. The packerfoot of claim 29, wherein said plurality of layers of rubber consists of five layers of rubber.

36. A packerfoot for anchoring a tool within a borehole, comprising:

an elongated mandrel adapted to longitudinally slidably engage an elongated body of a tool;

a first elongated bladder attachment portion surrounding a length of said mandrel;

a second elongated bladder attachment portion surrounding a length of said mandrel; and an elongated generally tubular inflatable bladder having a retracted position in which said bladder permits substantially free relative movement between said packerfoot and an inner surface of a borehole, and an inflated position in which said bladder substantially limits relative movement between said packerfoot and said inner surface of said borehole, said bladder having a first end and a second end, said first end bonded to said first bladder attachment portion along a first bond length of said bladder, said second end bonded to said second bladder attachment portion along a second bond length of said bladder, said bladder having a fiber-reinforced component having a thickness;

wherein the ratio of said first bond length of said bladder to said thickness is greater than 25, and the ratio of said second bond length of said bladder to said thickness is greater than 25.

37. The packerfoot of claim 36, wherein the ratio of said first bond length of said bladder to said thickness is greater than 50, and the ratio of said second bond length of said bladder to said thickness is greater than 50.

* * * * *